US006497391B1

(12) United States Patent
Timm

(10) Patent No.: US 6,497,391 B1
(45) **Date of Patent: *Dec. 24, 2002**

(54) PERSONAL COMPUTER KEYBOARD AND MOUSE SUPPORT HAVING MOVEABLE MOUSE EXTENSION

(75) Inventor: Derek Timm, Windsor, CA (US)

(73) Assignee: Work-Rite Ergonomic Accessories, Inc., Petaluma, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/383,974

(22) Filed: Aug. 26, 1999

Related U.S. Application Data

(63) Continuation-in-part of application No. 09/135,322, filed on Aug. 7, 1999, now Pat. No. 6,045,098.

(51) Int. Cl.[7] ..... B68G 5/00

(52) U.S. Cl. ..... 248/118; 248/118.1; 248/346.01; 248/918; 108/50.01

(58) Field of Search ..... 248/118, 118.1, 248/346.01, 918; 400/715; 108/50.01, 50.03, 150; 312/208.1, 223.3

(56) References Cited

U.S. PATENT DOCUMENTS

| | | | |
|---|---|---|---|
| 64,170 | A | 4/1867 | Gaasbeek |
| 170,837 | A | 10/1875 | Finfrock |
| 1,867,462 | A | 7/1932 | Thompson |
| 2,182,703 | A | 12/1939 | Rainwater |
| 3,637,278 | A | 1/1972 | Easterbrooks |
| 3,983,976 | A | 10/1976 | Taylor |
| 4,206,546 | A | 6/1980 | Runnells et al. |
| 4,953,716 | A | 9/1990 | Rapoport |
| 5,242,139 | A | 9/1993 | Aldrich |

(List continued on next page.)

OTHER PUBLICATIONS

Two page brochure entitled "Talkmaster Telephone Swivel Arms The Perfect Base for Commuication" published by Talkmaster Telephone Arms, published on Mar. 10, 1996.

(List continued on next page.)

*Primary Examiner*—Kimberly Wood
(74) *Attorney, Agent, or Firm*—Watts, Hoffmann, Fisher & Heinke, Co., L.P.A.

(57) ABSTRACT

A keyboard and mouse support includes a keyboard support body and a mouse support. The keyboard support body includes a throughpassage that passes through the support body and opens on opposite sides of the support body. The keyboard support body also defines a support surface configured to accommodate a keyboard such as a keyboard for inputting alphanumeric symbols to a personal computer. The moveable mouse support fits within a portion of the throughpassage of the support and extends outwardly from the support to define a mouse support surface having a region that extends in front of a front edge of a keyboard with the keyboard resting the support surface. Although the term "mouse" has become almost universally used for the rolling input device used to move an arrow on the display screen and "pick" functions or data values, other terms such as "trackball" can be used interchangeably with the term "mouse". The mouse support includes an upwardly protruding elongated bead spaced inwardly from a rearward edge of the mouse support. The bead is substantially circular in cross section and is fixed within a recess in an upper surface of the mouse support and an upper portion of the bead extends above an upper surface of the mouse support. A downwardly facing surface of the keyboard support bounding the throughpassage includes a recess sized to slidably receive the upper portion of the bead extending above the upper surface of the mouse support. The bead prevents a mouse placed on either of the two mouse support surfaces from sliding off the back edge of the mouse support if the mouse support is inclined at a negative angle. A wrist support is affixed to an upper support surface of the keyboard support body using a plurality of ball catch type fasteners.

38 Claims, 4 Drawing Sheets

U.S. PATENT DOCUMENTS

| | | | | |
|---|---|---|---|---|
| 5,273,250 | A | | 12/1993 | Pemberton |
| D352,278 | S | | 11/1994 | Sharpe, III et al. |
| D357,241 | S | | 4/1995 | Rossman |
| D357,910 | S | | 5/1995 | Newhouse |
| 5,463,925 | A | | 11/1995 | Galocy |
| 5,490,647 | A | | 2/1996 | Rice |
| 5,509,628 | A | | 4/1996 | Noble |
| 5,522,323 | A | | 6/1996 | Richard |
| 5,522,572 | A | | 6/1996 | Copeland et al. |
| 5,558,419 | A | | 9/1996 | Dasher |
| 5,564,667 | A | | 10/1996 | Copeland et al. |
| 5,583,496 | A | | 12/1996 | Sharpe, III et al. |
| 5,584,596 | A | | 12/1996 | Greene |
| 5,612,691 | A | | 3/1997 | Murmann et al. |
| 5,628,483 | A | | 5/1997 | Smith et al. |
| D380,462 | S | | 7/1997 | Wilson |
| 5,653,413 | A | | 8/1997 | Fink |
| 5,655,743 | A | | 8/1997 | Gillis |
| 5,667,320 | A | | 9/1997 | Ambrose et al. |
| 5,683,064 | A | | 11/1997 | Copeland et al. |
| 5,692,815 | A | | 12/1997 | Murphy |
| 5,704,298 | A | | 1/1998 | Corpuz, Jr. |
| 5,704,299 | A | | 1/1998 | Corpuz, Jr. |
| 5,704,698 | A | | 1/1998 | Lin |
| D391,941 | S | | 3/1998 | Brunner |
| 5,730,403 | A | | 3/1998 | Johnson |
| 5,732,910 | A | | 3/1998 | Martin |
| 5,803,416 | A | | 9/1998 | Hanson et al. |
| 5,813,741 | A | | 9/1998 | Fish |
| 5,833,923 | A | | 11/1998 | McClintock |
| 5,857,415 | A | | 1/1999 | Richard |
| 5,890,694 | A | | 4/1999 | Possick |
| 5,901,934 | A | | 5/1999 | Wilson |
| D410,453 | S | | 6/1999 | Timm |
| 5,915,655 | A | | 6/1999 | Gutowski |
| 5,938,352 | A | | 8/1999 | Chen |
| 6,045,098 | A | * | 4/2000 | Timm ..... 248/118 |

OTHER PUBLICATIONS

Three pages printout downloaded from Steelcase Inc. web site featuring various products including the Steelcase Stella Keyboard Support, publication date unknown. Third page of printout includes a copyright notice as follows: "© 1996–2000 STeelcase Inc.".

Two pages (front page and p. 134) from catalog entitled "Corporate Express The World's Corporate Supplier In–Stock Products 1997" published by Corporate Express, p. 134 featuring various Rubbermaid products, publication date 1997.

Two page brochure featuring various products of ISE, Inc., publication date unknown. The ISE brochure was obtained by Applicant's assignee at an industry trade show in Chicago, Illinois on Jun. 8, 1999.

Fifteen page price list entitled "U.S. Wrist Rest, Foot Rest and Combo–Platform Price List" published by ISE, Inc., publication date Sep. 1994.

Fourteen page catalog entitled "Welcome to the World of Visual Ergonomics User Friendly Accessories for Todays Workplace! 1996 Catalog" published by ISE, Inc., published in 1996.

Six page brochure entitled "The ABC's of Office Ergonomics" published by WorkRite Ergonomic Accessories, Inc., publication date unknown. To the best of Applicant's knowledge, this brochure was published at least as early as 1996.

Four page product brochure entitled "Introducing . . . Rite–In–Line Document and Writing Platform" published by WorkRite Ergonomic Accessories, Inc., publication ate unknown. To the best of Applicant's knowledge, this brochure was published at least as early as 1997.

Four page product prochure entitled "Introducing . . . PowerLift Sit–Stand Work Surface" published by WorkRite Ergonomic Accessories, Inc., publication date unk nown. To the best of Applicant's knowledge, this brochure was published at least as early as Jul. 1996.

Four page product brochure entitled "PowerLift Mechanisms for Sit–Stand Applications" published by WorkRite Ergonomic Accessories, Inc., publication date unknown. To the best of Applicant's knowledge, this brochure was published at least as early as Jun. 1997.

Nine page price list and brochures for various products of WorkRite Ergonomic Accessories, inc., price list date Feb. 1, 1994.

Twenty–one page catalog and price list entitled "General Service Administration Feder Supply Service Authorized Federal Supply Schedule Pricelist Sep. 1, 1996" published by WorkRite Ergonomic Accessories, Inc., price list date Sep. 1, 1996.

Four page brochure entitled "Introducing Rite–In–Touch™ Telephone Arm" published by WorkRite Ergonomic Accessories, Inc., copyright, 1997.

Six page product brochure entitled "NeutraLift™ Height Adjustable Counter–Balanced Tables" published by WorkRite Ergonomic Accessories, Inc., copyright 1998.

Four page product brochure "Fall 1998 New Products Introducing the . . . Banana–Board™ and the PINNACLE™ Arm Series" published by WorkRite Ergonomic Accessories, Inc., printed in Fall 1998.

Eighteen page catalog entitled "WorkRite® Ergonomic Accessories, Inc." published by WorkRite Ergonomic Accessories, Inc., printed in Oct. 1994.

Twenty page catalog entitled "WorkRite® Ergonomic Accessories, Inc. Feb. 1995" published by WorkRite Ergonomic Accessories, Inc., printed in Feb. 1995.

Twenty–three page catalog entitled "WorkRite Ergonomics Spring 1996 Catalog" published by WorkRite Ergonomic Accessories, Inc., printed in Fall 1995.

Twenty–three page catalog entitled "WorkRite Ergonomics Spring 1996 Catalog" published by WorkRite Ergonomic Accessories, Inc., printed in Spring 1996.

Twenty–five page catalog entitled "WorkRite® Ergonomics Spring 1997 Catalog" published by WorkRite Ergonomic Accessories, Inc., printed in Dec. 1996.

Thirty–eight page catalog entitled "WorkRite® Ergonomics Fall 1997 Catalog" published by WorkRite Ergonomic Accessories, Inc., printed in Fall 1997.

Thirty–eight page catalog entitled "WorkRite® Ergonomics Spring 1998 Catalog" published by WorkRite Ergonomic Accessories, Inc., printed in Spring 1998.

Fifty page catalog entitled "WorkRite® Ergonomics 1999 Catalog" published by WorkRite Ergonomic Accessories, Inc., copyright 1999.

* cited by examiner

PERSONAL COMPUTER KEYBOARD AND MOUSE SUPPORT HAVING MOVEABLE MOUSE EXTENSION

RELATED APPLICATION

This application is a continuation-in-part of U.S. application Ser. No. 09/135,322, filed on Aug. 7, 1999, now issued as U.S. Pat. No. 6,045,098 on Apr. 4, 2000.

FIELD OF THE INVENTION

The present invention concerns a computer keyboard support having a movable extension that supports a data input device, such as a mouse, for controlling a cursor position on a computer viewing screen.

BACKGROUND ART

The personal computer revolution has placed personal computers and computer terminals on corporate and home desktops throughout the world. Almost all such computers and terminals allow data entry through an alphanumeric keyboard. Often such a keyboard rests on a level desktop surface which is the same as the surface that supports a computer base unit and a viewing monitor or screen.

Especially when the user must work at the computer for long periods of time, it is important to be able to adjust the position and/or orientation of the keyboard. Built in tabs that form an integral part of the keyboard allow for limited tilt adjustment. To allow more flexibility in positioning a keyboard to suit a user's ergonomic requirements, however, the keyboard needs its own support.

Different types of keyboard supports are sold by Work-Rite Ergonomic Accessories, Inc., the assignee of the present invention. One such keyboard support is movably supported by a track and support mechanism that allows the keyboard to be moved out from under a user's desk and then stored beneath the desk when the keyboard is not in use. This keyboard support also allows the user to adjust both the angle and the height of the keyboard in relation to the user.

A common personal computer input device that has received wide acceptance is a two dimensional input control device commonly referred to as a "mouse." As the mouse is moved over a flat surface a roller that extends from a bottom of the mouse rotates and this rotation is translated into electrical signals that are transmitted to an interface of the personal computer. The movement of the mouse on the surface causes a corresponding movement of an arrow on the computer screen. By moving the arrow to point at a desired icon, function block, dialog box, or pull down menu, the user can actuate switches on the mouse to select or pick icons, or functions, actuate pull-down menus, select a block of text for editing, enter data, etc.

U.S. Pat. No. 5,655,743 to Gillis concerns a keyboard tray which is formed from two relatively shallow molded bodies united along a periphery to define a relatively flat, internal chamber through either of opposite side edges of the keyboard support or tray. A mouse tray can project outwardly of the internal chamber through either of opposite side edges of the keyboard support.

SUMMARY OF THE INVENTION

One exemplary embodiment of the present invention concerns a keyboard and mouse support for a personal computer. The keyboard and mouse support includes a keyboard support and a moveable support adapted to support a moveable pointer input device, such as a mouse. To accommodate the moveable mouse support, the keyboard support includes a support body having a throughpassage that passes through the support body and opens on opposite sides of the support body. The moveable support is slidably positioned in the throughpassage. The support body defines a support surface configured to accommodate an alphanumeric keyboard for inputting signals corresponding to alphanumeric symbols to the computer.

The mouse or pointer device typically includes a roller that requires a generally flat surface for its support and rotation of the roller. Although the term "mouse" has become almost universally used for a moveable pointer input device, other terms such as "trackball" can be used interchangeably with the term "mouse."

The moveable support or moveable mouse support fits within a portion of the throughpassage of the keyboard support and can be extended outwardly from the keyboard support to define a mouse support surface. A portion of the mouse support extends in front of a front edge of a keyboard as the keyboard rests on the keyboard support surface.

The exemplary keyboard and mouse support includes a keyboard support body having a curved slot that extends through the support body. The keyboard support also includes a moveable mouse support that defines an arcuate body that fits within the curved slot of the support body and can be pushed back and forth through the curved slot to extend beyond one or the other side of the keyboard support body. Due to its curved or arcuate shape of the mouse support, an exemplary embodiment of the moveable mouse support defines a work region that extends beyond a front edge of the keyboard support body.

Advantageously, the mouse support includes an upwardly protruding bead that extends just inward of a back edge of the mouse support. The bead prevents a mouse placed on either of the two mouse support work regions from sliding off the back edge of the mouse support. If the keyboard and mouse support is adjusted to a negative angle, the mouse would tend to roll off the back of the mouse support if no bead were present along the back edge of the mouse support. A negative angle of the mouse and keyboard support is one in which the front edge (the edge facing toward the user) of the keyboard support is vertically above the back edge (the edge facing toward the monitor) of the keyboard support. The bead may be a cylindrical shaped length of rubber or plastic, such as a length of material forming a conventional O-ring. Preferably, the bead is seated in an arcuate recess or groove in an upper surface of the mouse support. The bead may be adhesively affixed in the recess and a portion of the bead extends above the upper surface of the mouse support. The mouse support recess is generally parallel to the back edge of the mouse support and is disposed just inward from the back edge. Preferably, a surface of the keyboard support body bounding the throughpassage also includes a corresponding groove or recess aligned with the mouse support recess to receive the upper portion of the bead extending above the mouse support upper surface.

These and other objects, advantages, and features of the exemplary embodiment of the invention are described in detail in conjunction with the accompanying drawings.

DETAILED DESCRIPTION OF AN EXEMPLARY EMBODIMENT

Figure 1:
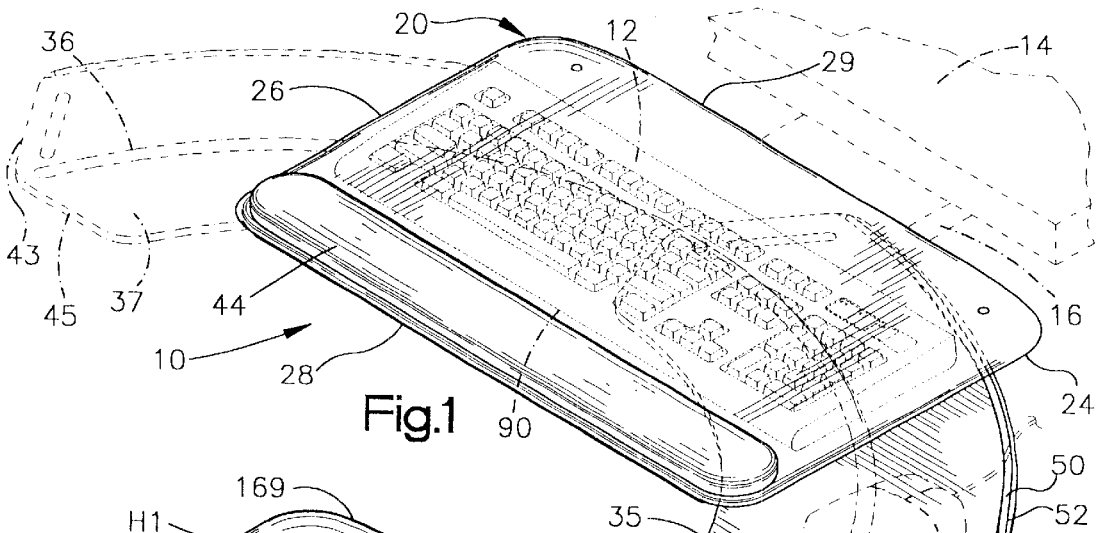
FIG. 1 is a perspective view of a keyboard and mouse support constructed in accordance with an exemplary embodiment of the invention.

Turning now to the drawings, FIG. 1 is a perspective view of a keyboard and mouse support 10 of the present invention. The keyboard and mouse support 10 is used to support a keyboard 12 in position for typing and a moveable pointer input device or mouse 13 in a position for mouse controlled function selection and/or data entry. The keyboard 12 and mouse 13 are typically coupled to a computer or workstation (not shown) resting on a desk (shown in dashed line at 14) for providing a working surface for a user. The keyboard and mouse support 10 may be mounted to a base that includes retractable arm (shown in dashed line at 16 in FIG. 1) that extends out from beneath the desk 14 and allows the user to adjustably position the keyboard 12 relative to the desk 14.

Overall Structure of Keyboard and Mouse Support 10

The keyboard and mouse support 10 includes a keyboard support body 20 having a cutout or throughpassage 22 (FIG. 2) that defines a track for a moveable mouse support 30. A top surface 150 of the keyboard support body 20 defines a support surface configured to accommodate the keyboard 12. The throughpassage 22 is a curved slot that extends through the keyboard support body 20. The mouse support 30 fits within a portion of the throughpassage 22 of the support body 20 and can be moved to extend outwardly to the right of the support body 20 to define a first mouse support surface 34 that includes a first region 35 (FIG. 1) in front of a front edge 42 of the keyboard 12 as the keyboard is resting on the keyboard support body 20. The mouse support 30 may also be slidably move to the left within the throughpassage 22 of the support body 20 such that a portion of the mouse support 30 extends outwardly to the left of the support body 20 to define a second mouse support surface 36 that includes a first region 37 (FIG. 7) in front of a front edge 42 of the keyboard 12 as the keyboard is resting on the keyboard support body 20.

A wrist support 180 extends above the supporting surface 32 and is attached the keyboard support body 20 adjacent a front edge 28 of the keyboard support body 20. The wrist support 180 contacts a user's wrist as the user types at the keyboard 12. As can best be seen in FIG. 9, the wrist support 180 is comprised of a resilient foam 182 confined within a plastic case or covering 183 and has a thin rigid metal or plastic base 184 with a pair of apertures.

Keyboard Support Body 20

Figure 2:
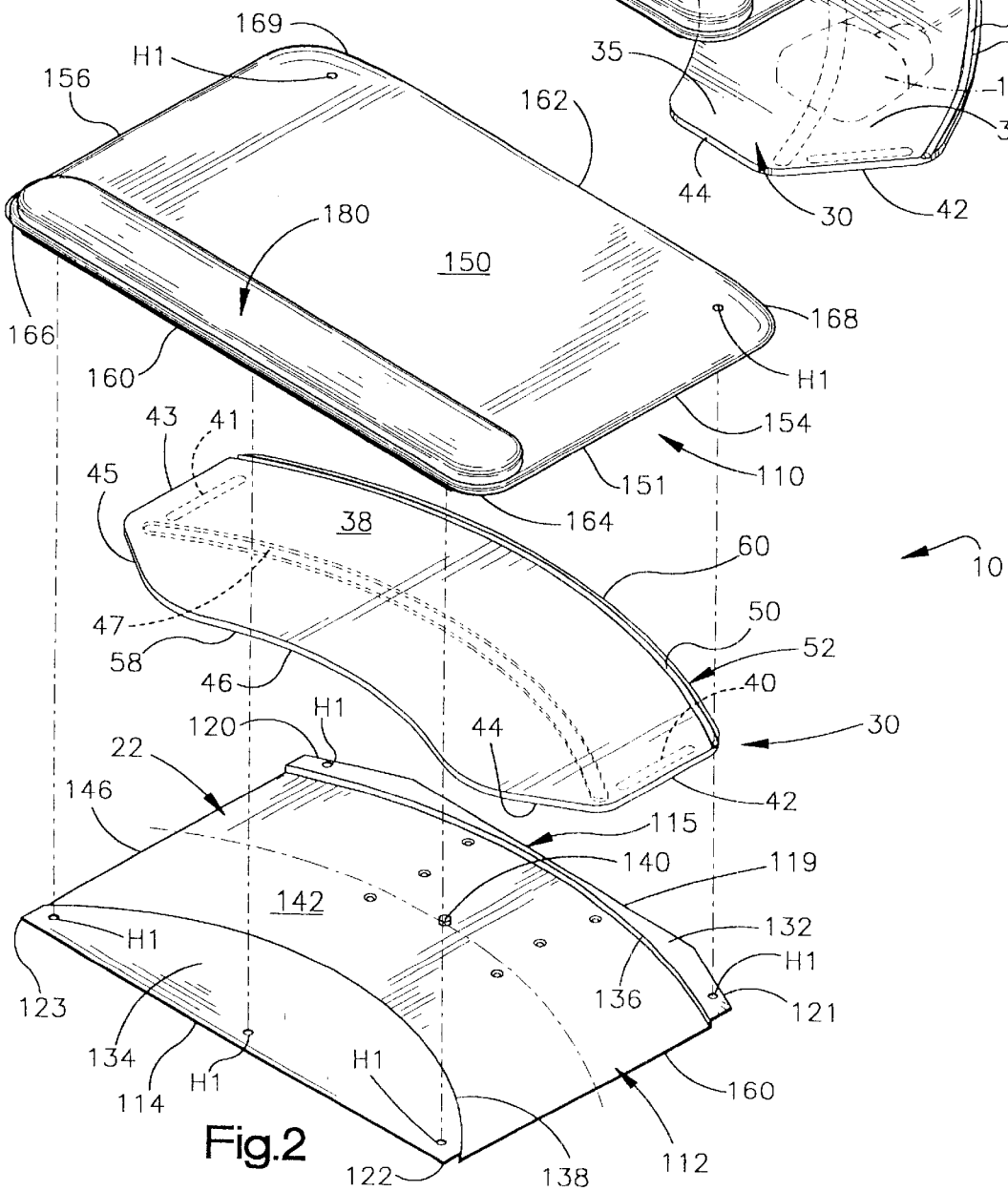
FIG. 2 is an exploded perspective view of the keyboard and mouse support of FIG. 1.

As seen in the exploded perspective view of FIG. 2, the keyboard support body 20 is made up of top and bottom body pieces 110, 112 that mate with each other along an outer periphery of the support body 20. A top piece 110 is generally rectangular in plan view. A front or forward edge 160 (facing the user of the keyboard 12) extends between two rounded corners 164, 166 and a rear or rearward edge 162 (away from the user of the keyboard 12) of the top piece 110 extends between two rounded corners 168, 169. A distance D1 (FIG. 3) from the front edge 160 to the rear edge 162 of the keyboard support body top piece 110 is about 13¼ inches in one exemplary embodiment of the invention. The upper surface of the top piece 110 defines the upper support surface 150 of the keyboard support body 20.

Figure 3:
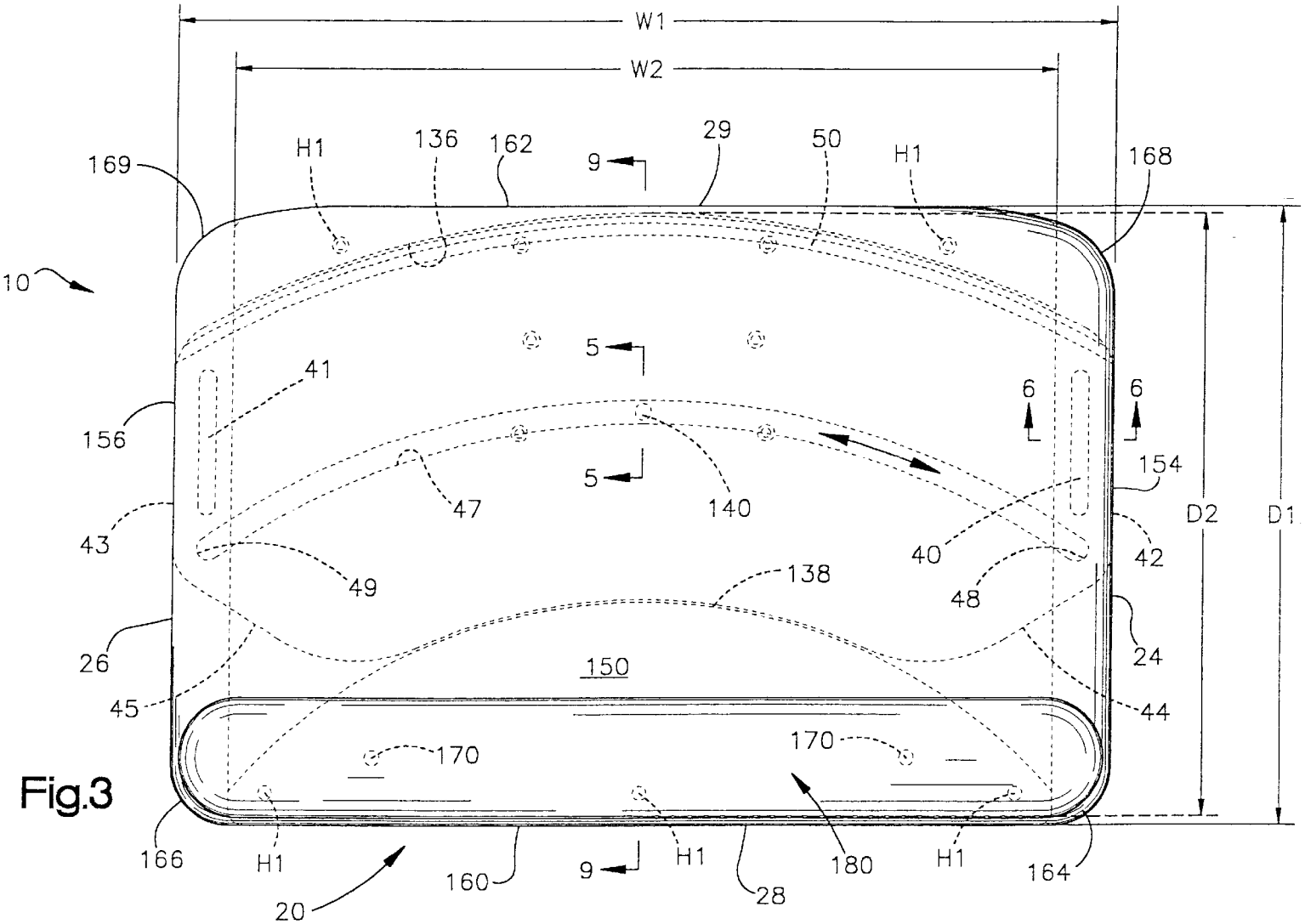
FIG. 3 is a top plan view of the keyboard and mouse support of FIG. 1.
Figure 4:
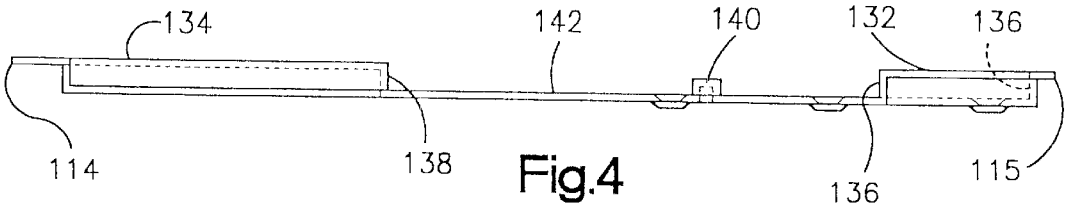
FIG. 4 is an end elevation view of a bottom piece of a keyboard support body.

The corresponding distance from a front edge 114 to a rear edge 115 of the keyboard support body bottom piece 112, labeled D2 in FIG. 3, is about 12⅞ inches. The width of the top piece 110 from the right edge 24 to the left edge 26 is approximately 20 inches (labeled as W1 in FIG. 3), while the width of the bottom piece 112 is approximately 17½ inches (labeled as W2 in FIG. 3). The radius of the rounded corners 114, 115, 116, 117 is preferably 1.25 inches.

As seen in the perspective view of FIG. 2, the bottom piece 112 also has two rounded corners 122, 123 forming the respective ends of the front edge 114. The rear edge 115 made up of three segments 119, 120, 121. Segment 120 is parallel with respect to the front edge 114, while segments 119 and 121 are angled slightly toward the front of the bottom piece 112. The bottom piece 112 defines the arcuate throughpassage or cutout 22 which accommodates back and forth movement of the mouse support 30. The throughpassage 22 is bounded by rear and front raised segments 132, 134 (FIG. 2). The rear raised segment or portion 132 has a curved edge 136 that extends in an arc from a left side of the bottom piece 112 to a right side of the bottom piece 112. The curved edge 136 is generally symmetric about a centerline coincident with the line 5—5 of FIG. 3 passing through the bottom piece 112. The forward raised segment or portion 134 defines a second edge 138 facing the rear curved edge 136.

The rear and front raised portions 132, 134 confine the mouse support 30 to arcuate movement along a curved path of travel within the throughpassage 22. The radius of curvature of the front curved edge 138 is about 11.9 inches and the radius of curvature of the rear curved edge 136 is about 20.1 inches. The center of both the radii of curvature is approximately 7.625 inches forward of a front edge 139 of the bottom piece 112.

Figure 9:
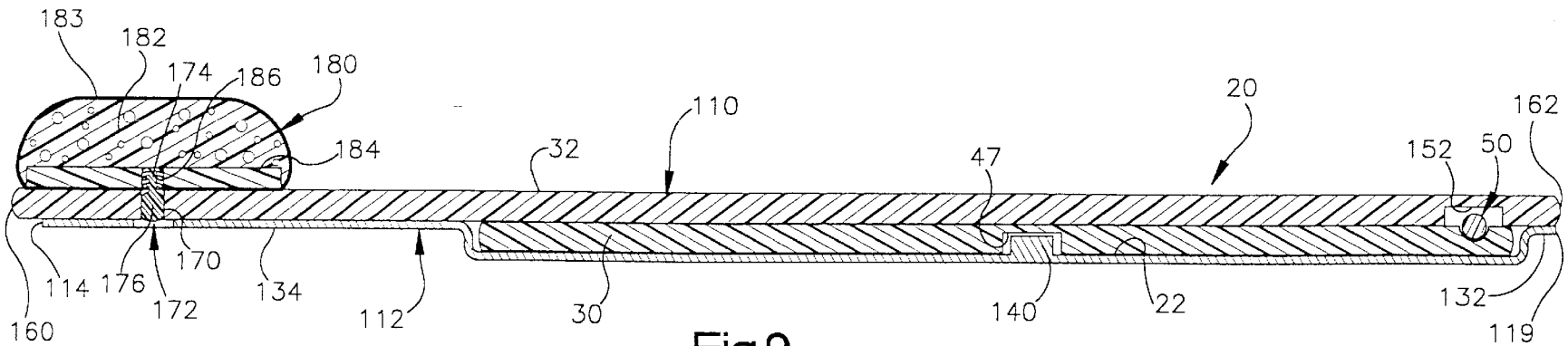
FIG. 9 is a sectional view of the keyboard and mouse support of FIG. 1.

The wrist support 180 is affixed to the upper surface 150 of the top piece 110 via a pair of ball catch fasteners 172 (one of which is seen in cross section in FIG. 9). Respective stem portions 174 of the ball catch fasteners 172 are disposed in a pair of 0.3125 inch diameter holes in a rigid fiberboard base 184 of the wrist support 180 and are held in place by friction. The ball portions 176 of the ball catch fasteners 172 extend through aligned holes 170 in the keyboard support body top piece 110. Since the ball portions 176 of the ball catch fasteners 172 are of greater diameter than the aligned holes in the top piece 110 (0.350 inch versus 0.3125 inch), the ball portions 176 are compressed and the wrist support 180 and top piece 110 are fixedly attached via frictional force between the compressed ball portions 176 and the top piece 110 and between the compressed stem portions 174 and the wrist support fiberboard base 184. Two aligned holes providing for clearance are also provided in the bottom piece 112 given that the compression of the ball portions within their respective top piece holes 170 elongates the ball portions slightly. A suitable ball catch fastener 170 is Part No. 320-322880-03 Mini Ball Tree-Lok fastener manufactured by ITW Fastex, 195 Algonquin Road, Des Plaines, Ill. 60016. The two holes 170 in the top body piece 110 are spaced approximately 9.5 inches apart.

In accordance with an exemplary embodiment of the invention, the top keyboard support piece 110 and the mouse support 30 are machined composite plastic (paper based phenolic) members, preferably ¼ inch thick. The paper base material is impregnated with phenolic resin and then cured to make the rigid top piece 110 and the mouse support 30. The bottom keyboard support piece 112 is a metal (steel) stamping having a thickness of about 0.073 inches. The metal stamping is deburred and painted prior to assembly of the keyboard and mouse support 10. Of course, those skilled in the art will recognize that the top piece, mouse support and bottom piece may be suitably fabricated of various other materials including wood, fiberboard, plastics such as polypropylene and ABS, sheet molded materials, etc.

A bottom surface 151 of the top piece 110 rests against the raised portions 132, 134 of the bottom piece 112. Connectors (not shown) pass through five aligned holes H1 in the two pieces 110, 112 to attach the two pieces together after the mouse support 30 has been positioned within the through-passage 22. Suitable connectors include #10×32⅜ inch long flat Phillips head screws which thread into suitable steel nut inserts press fit into the holes H1. The holes H1 in the top piece 110 are 5 millimeters in diameter and are countersunk adjacent the upper surface 150 to 0.375 inch diameter. The three holes H1 near the front edge 160 of the top piece 110 are spaced apart 8 inches and the two outer two holes are 2 inches from the right and left sides 154, 156 of the top piece 110. The two holes H1 near the back edge 162 are spaced apart 11.5 inches and are 4.25 inches from the sides 154, 156.

As seen in the perspective view of FIG. 2, a pin 140 extends upwardly from a generally planar surface 142 of the curved throughpassage 22. The pin 140 forms a stop that limits the extent of movement of the mouse support 30 as will be explained below.

As is best seen in FIG. 9, the bottom surface 151 of the top piece 110 includes an arcuate rectangular groove or recess 152 to provide clearance for an elongated bead 50 extending upwardly from the mouse support 30. The elongated bead 50 will be described below. Preferably, the recess 152 is ½ inch wide and 5⁄32 inch in depth. The recess 152 is arcuate and aligned with the mouse support capture bead 50.

Figure 6:
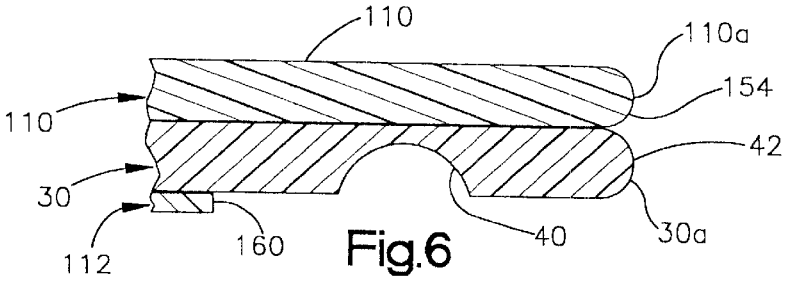
FIG. 6 is a sectional view as seen from a plane indicated by the line 6—6 in FIG. 3.

Edges of the top piece 110 and the mouse support 30 are exposed to contact by the user. As seen in the section view of FIG. 6, the top piece 110 and the mouse support 30 have rounded or contoured edges 110*a*, 30*a* respectively that extend around an outer periphery of those members.

Mouse Support 30

The mouse support 30 is an arcuate board-like member with front and back arcuate edges 58, 60 of the mouse support 30 having substantially the same radius of curvature as the curved edges 138, 136 defining the throughpassage 22 so that it fits within the curved slot defined by the through-passage 22. The radius of curvature of the front edge 58 of the mouse support 30 is slightly larger than the radius of curvature of the edge 138 and the radius of curvature of the back edge 60 of the mouse support 30 is slightly smaller than the radius of curvature of the edge 136 to allow for clearance. The center of all four radii of curvature is substantially identical, being located approximately 7.625 inches forward of a front edge 139 of the bottom piece 112.

Figure 7:
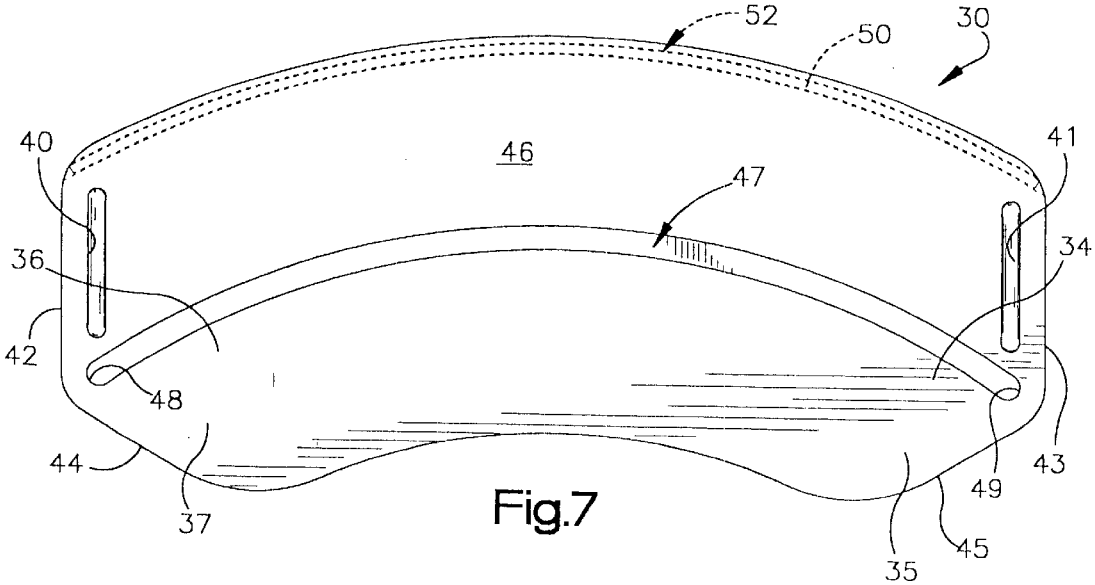
FIG. 7 is a bottom plan view of a slidable mouse support.
Figure 10:
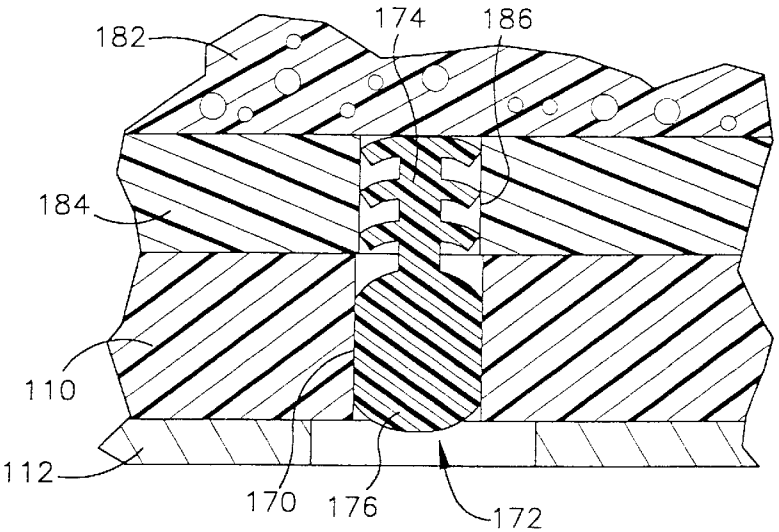
FIG. 10 is a sectional view of a ball catch fastener used to affix a wrist support to a keyboard support body of the keyboard and mouse support body.
Figure 8:
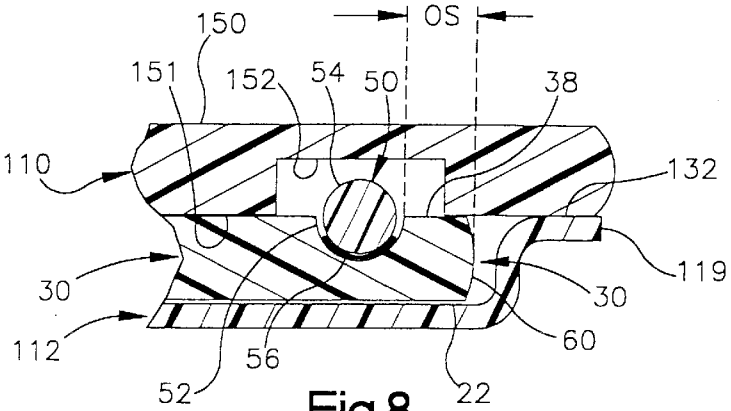
FIG. 8 is a sectional view of the slidable mouse support as seen from a plane indicated by the line 8—8 in FIG. 7.

The mouse support 30 includes an upper surface 38 and a lower surface 46 (FIGS. 2 and 8). A position of the mouse support 30 relative the keyboard support body 20 is adjusted by pushing the mouse support 30 back and forth through the slot-shaped throughpassage 22. The mouse support 30 can be extended by the user to a position beyond one or the other side of the keyboard support body 20 so that the curve of the arcuate mouse support body 30 positions work regions 34, 36 defined by the mouse support 30 to either the left and forward of the keyboard 12 (region 37 in FIG. 7) or to the right and forward of the keyboard 12 (region 35 in FIG. 7).

As is shown in solid line in FIG. 1, in a first position, the mouse support 30 is moved to the right, as seen from a perspective of a user of the keyboard 12, the first mouse support work region 34 is defined adjacent right end portions 42, 44 of the mouse support 30. Particularly, a portion of the first mouse support work region 34 includes a first extending region 35 that extends forward of the keyboard front edge 90 and is adjacent the right end portion 44 when the mouse support 30 is in the first position. As is shown in dashed line in FIG. 1, in a second position, the mouse support 30 is moved to the left, as seen from a perspective of a user of the keyboard 12, the second mouse support work region 36 is defined adjacent left end portions 43, 45 of the mouse support 30. Particularly, a portion of the first mouse support work region 36 includes a second extending region 37 that extends forward of the keyboard front edge 90 and is adjacent the right end portion 45 when the mouse support 30 is in the second position. As is shown in FIG. 3, when in an intermediate or middle position, the mouse support 30 is hidden from view within the throughpassage 22 of the keyboard support body 20.

Figure 5:
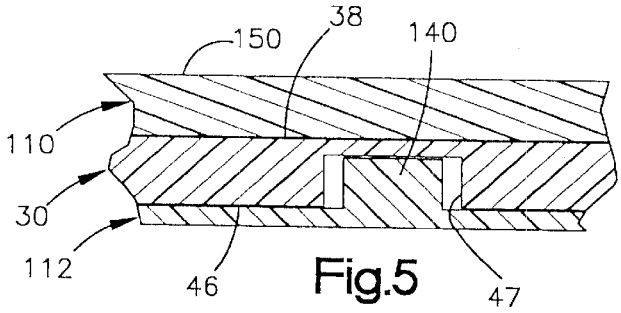
FIG. 5 is a sectional view as seen from a plane indicated by the line 5—5 in FIG. 3.

As is best seen in FIG. 7, a bottom surface 46 of the mouse support 30 defines an arcuate slot 47 that extends upwardly into the mouse support body. When the top and bottom body pieces 110, 112 of the keyboard support body 20 are assembled, the pin 140 extends into the slot 47 as seen in the section view of FIG. 5. When the user pulls the mouse support 30 out from the keyboard support body 20, the user is able to move the mouse support 30 until the pin 140 butts against either a right end 48 or a left end 49 of the slot 47. In the configuration shown in solid line in FIG. 1, with the mouse support extending beyond the right hand side 24 of the keyboard support body 20, the stop pin 140 butts against a right end 48 of the slot 47 and with the mouse support 30 extending from the left hand side of the keyboard support body 20, the pin 140 butts against the left end 49 of the slot 47.

As mentioned above, the bottom piece 112 of the support body 20 has a width W of about 17½ inches from the right edge 144 to the left edge 146. This is shorter than the width of the top piece 110 (about 20 inches) and allows the user to reach under the keyboard support 20 and grasp the mouse support 30. In order to allow the user to more easily grasp the mouse support 30, the mouse support 30 defines two notches 40, 41 along two oppositely facing generally straight edge portions 42, 43 (FIG. 2) of the mouse support 30. As seen in the plan view of FIG. 3, the straight edge portions 42, 43 generally align with opposite sides 24, 26 of the keyboard support body 20 with the mouse support 30 in its hidden middle position. As seen in the perspective view of FIG. 1, beveled or angled edge portions 44, 45 of the mouse support 30 extend generally parallel to the front edge 90 of the keyboard 12 and also extend in front of the front edge 28 of keyboard support body 20.

Advantageously, the mouse support 30 includes the upwardly protruding elongated mouse capture bead 50 that extends along a back or rear edge 60 of the mouse support 30. The bead 50 is arcuate, a center line of the bead 50 having a radius of curvature of approximately 19.75 inches and a center of the radius of curvature corresponding to the center of the radii of curvatures of the rear and front curved surfaces 136, 138 and the front and back edges 58, 60 of the mouse support 50. A center line of the arcuate bead 50 is offset inwardly from the back edge 60 of the mouse support about 0.1875 (3/16) inch, labeled as OS in FIG. 8.

The bead 50 prevents the mouse 13 when placed on either of the two mouse support work regions 34, 36 from sliding off the back edge 60 of the mouse support 30. If the keyboard and mouse support 10 is adjusted to a negative angle, the mouse would tend to roll off the back of the mouse support 30 if no upwardly protruding member such as the bead 50 were disposed along the back edge 60 of the mouse support 30. A negative angle of the mouse and keyboard support 10 is one in which the front edge 28 (the edge facing toward the user) of the keyboard support body 20 is at a higher vertical position than the back edge 29 (the edge facing away from the user) of the keyboard support body 20.

Preferably, the bead 50 is generally cylindrical in shape. One suitable flexible material for the bead 50 is 0.020 inch diameter Buna-N O-ring cord. However, it should be understood that other materials such as rigid plastic materials formed with the appropriate arcuate shape and size are also suitable for the bead 50. The material selected for the bead 50 should have a relatively high coefficient of friction to prevent the mouse 13 from "jumping" over the bead 50 when the support 10 is adjusted to a negative angle while still maintaining a low profile for the bead 50, that is, minimizing the distance that the bead 50 must extend above the upper surface 150 to keep the mouse 13 "captured" in the right and left mouse support work regions 34, 36. As can best be seen in FIG. 8, the bead 50 is seated in an arcuate recess or groove 52 in the planar upper surface 38 of the mouse support 30. The recess 52 is preferably a ¼ inch diameter semicircle formed with an appropriate router bit. The bead 50 may be affixed by adhesive 54 disposed between the portion of the mouse support defining the recess 60 and the bead 50. An upper portion 52 of the bead 50 extends above the upper surface 38 of the mouse support 30. One suitable adhesive 54 is cyanoacrylate. Other adhesives such as PSA tape, hot melts, or solvent based adhesives known to those skilled in the art may also be suitably employed. As can be seen in FIG. 9, clearance for the upper portion 52 of the bead 50 is provided by the recess 152 in the lower surface 150 of the top piece 110.

While the present invention has been described with a degree of particularity, it is the intent that the invention include all modifications and alterations from the disclosed design falling with the spirit or scope of the appended claims.

I claim:

1. A computer keyboard and mouse support comprising:

a) a keyboard support having an upper support surface for supporting a computer keyboard and that defines a throughpassage extending between opposite sides of the keyboard support for slidably receiving a mouse support;

b) the mouse support including first and second mouse support surfaces adjacent opposite ends of the mouse support, the mouse support being sized to slide within the keyboard support throughpassage between first and second positions, in the first position of the mouse support the first mouse support surface extending outwardly beyond one side of the keyboard support providing a support area for a computer mouse and in the second position of the mouse support the second mouse support surface extending outwardly beyond an opposite side of the keyboard support providing a support area for a computer mouse; and c) wherein the mouse support includes an upwardly protruding member positioned adjacent rearward edges of the first and second mouse support surfaces to limit movement of a computer mouse placed on either of the first and second mouse support surfaces in a rearward direction beyond the upwardly protruding member.

2. The computer keyboard and mouse support of claim 1 wherein the upwardly protruding member comprises an elongated bead, a first length of the bead extending adjacent the rearward edge of the first mouse support surface and a second length of the bead extending adjacent the rearward edge of the second mouse support surface.

3. The computer keyboard and mouse support of claim 2 wherein the bead is continuous between the first and second lengths of the bead. 4.

4. The computer keyboard and mouse support of claim 2 wherein the first length of the bead is supported within a first recessed portion in an upper surface of the first mouse support surface and an upper portion of the first length of the bead extends upwardly beyond the first mouse support surface upper surface and the second length of the bead is supported within a second recessed portion in an upper surface of the second mouse support surface and an upper portion of the second length of the bead extends upwardly beyond the second mouse support surface upper surface.

5. The computer keyboard and mouse support of claim 4 wherein the first and second recessed portions comprise a continuous recess extending between the first and second mouse support surfaces and further wherein the bead is continuous between the first and second lengths of the bead and the bead is supported within the continuous recess, an upper portion of the bead extends upwardly beyond an upper surface of the mouse support.

6. The computer keyboard and mouse support of claim 3 wherein the bead is substantially circular in cross section and is fixed within a recess in an upper surface of the mouse support and an upper portion of the bead extends above an upper surface of the mouse support.

7. The computer keyboard and mouse support of claim 6 wherein a downwardly facing surface of the keyboard support bounding the throughpassage includes a recess sized to slidably receive the upper portion of the bead extending above the upper surface of the mouse support.

8. The computer keyboard and mouse support of claim 1 wherein the mouse support and the keyboard support throughpassage are arcuate with respect to a longitudinal axis extending between the opposite sides of the keyboard support.

9. The computer keyboard and mouse support of claim 8 wherein in the first position of the mouse support at least a portion of the first mouse support surface extends in front of a forward edge of the keyboard support facing a user of the computer keyboard and mouse support and in the second position of the mouse support at least a portion of the second mouse support surface extends in front of the forward edge of the keyboard support.

10. The computer keyboard and mouse support of claim 1 wherein a wrist support is disposed on the upper support surface of the keyboard support adjacent a forward edge of the keyboard support facing a user of the computer keyboard and mouse support.

11. A keyboard and mouse support comprising:

a) a keyboard support having an upper support surface for supporting a computer keyboard and defining an opening for slidably receiving a mouse support;

b) the mouse support including a first mouse support surface adjacent one end of the mouse support, the mouse support being sized to slide within the keyboard support opening between first and second positions, in the first position of the mouse support the first mouse support surface extending outwardly beyond a first side of the keyboard support providing a support area for a computer mouse and in the second position of the mouse support at least a portion of the first mouse support surface being disposed within the keyboard support; and c) wherein the mouse support includes a recess adjacent a rearward edge of the first mouse support surface and an upwardly protruding member positioned in the recess to limit movement of a computer mouse placed on the first mouse support surface in a rearward direction beyond the upwardly protruding member.

12. The keyboard and mouse support of claim 11 wherein:

a) the keyboard support opening is a throughpassage extending between opposite sides of the keyboard support;

b) the mouse support includes a second mouse support surface adjacent a second end of the mouse support, in the second position of the mouse support the second mouse support surface extending outwardly beyond a second side of the keyboard support providing a support area for a computer mouse; and c) the mouse support upwardly protruding member includes a portion positioned adjacent a rearward edge of the second mouse support surface to limit movement of a computer mouse placed on the second mouse support surface in a rearward direction beyond the upwardly protruding member.

13. The keyboard and mouse support of claim 12 wherein the upwardly protruding member comprises an elongated bead, a first length of the bead extending adjacent the rearward edge of the first mouse support surface and a second length of the bead extending adjacent the rearward edge of the second mouse support surface.

14. The keyboard and mouse support of claim 13 wherein the bead is continuous between the first and second lengths of the bead.

15. The keyboard and mouse support of claim 13 wherein the recess includes a first recessed portion in an upper surface of the first mouse support and a second recessed portion in an upper surface of the second mouse support surface and further wherein the first length of the bead is supported within the first recessed portion and an upper portion of the first length of the bead extends upwardly beyond the first mouse support surface upper surface and the second length of the bead is supported within the second recessed portion and an upper portion of the second length of the bead extends upwardly beyond the second mouse support surface upper surface.

16. The keyboard and mouse support of claim 15 wherein the recess is continuous between the first and second mouse support surfaces and further wherein the bead is continuous between the first and second lengths of the bead and the bead is supported within the recess, an upper portion of the bead extends upwardly beyond an upper surface of the mouse support.

17. The keyboard and mouse support of claim 14 wherein the bead is substantially circular in cross section and is fixed within the recess in an upper surface of the mouse support and an upper portion of the bead extends above an upper surface of the mouse support.

18. The keyboard and mouse support of claim 17 wherein a downwardly facing surface of the keyboard support bounding the throughpassage includes a recess sized to slidably receive the upper portion of the bead extending above the upper surface of the mouse support.

19. The keyboard and mouse support of claim 12 wherein the mouse support and the keyboard support throughpassage are arcuate with respect to a longitudinal axis extending between the opposite sides of the keyboard support.

20. The keyboard and mouse support of claim 19 wherein in the first position of the mouse support at least a portion of the first mouse support surface extends in front of a forward edge of the keyboard support facing a user of the computer keyboard and mouse support and in the second position of the mouse support at least a portion of the second mouse support surface extends in front of the forward edge of the keyboard support.

21. The keyboard and mouse support of claim 12 wherein a wrist support is disposed on the upper support surface of the keyboard support adjacent a forward edge of the keyboard support facing a user of the computer keyboard and mouse support.

22. The computer keyboard and mouse support of claim 1 wherein the upper support surface of the keyboard support includes a wrist support affixed to the keyboard support using a ball catch fastener.

23. The keyboard and mouse support of claim 11 wherein the upper support surface of the keyboard support includes a wrist support affixed to the keyboard support using a ball catch fastener.

24. A keyboard and mouse support comprising:

a) a keyboard support having an upper support surface for supporting a computer keyboard and defining an opening for slidably receiving a mouse support;

b) the mouse support including a first mouse support surface adjacent one end of the mouse support, the mouse support being sized to slide within the keyboard support opening between first and second positions, in the first position of the mouse support the first mouse support surface extending outwardly beyond a first side of the keyboard support providing a support area for a computer mouse and in the second position of the mouse support at least a portion of the first mouse support surface being disposed within the keyboard support; and c) wherein:

1) the mouse support includes an upwardly protruding member positioned adjacent a rearward edge of the first mouse support surface to limit movement of a computer mouse placed on the first mouse support surface in a rearward direction beyond the upwardly protruding member;

2) the keyboard support opening is a throughpassage extending between opposite sides of the keyboard support;

3) the mouse support includes a second mouse support surface adjacent a second end of the mouse support, in the second position of the mouse support the second mouse support surface extending outwardly beyond a second side of the keyboard support providing a support area for a computer mouse; and 4) the mouse support upwardly protruding member includes a portion positioned adjacent a rearward edge of the second mouse support surface to limit movement of a computer mouse placed on the second mouse support surface in a rearward direction beyond the upwardly protruding member.

25. The keyboard and mouse support of claim 24 wherein the upwardly protruding member comprises an elongated bead, a first length of the bead extending adjacent the rearward edge of the first mouse support surface and a second length of the bead extending adjacent the rearward edge of the second mouse support surface.

26. The keyboard and mouse support of claim 25 wherein the bead is continuous between the first and second lengths of the bead.

27. The keyboard and mouse support of claim 25 wherein the first length of the bead is supported within a first recessed portion in an upper surface of the first mouse support surface and an upper portion of the first length of the bead extends upwardly beyond the first mouse support surface upper surface and the second length of the bead is supported within a second recessed portion in an upper surface of the second mouse support surface and an upper portion of the second length of the bead extends upwardly beyond the second mouse support surface upper surface.

28. The keyboard and mouse support of claim 27 wherein the first and second recessed portions comprise a continuous recess extending between the first and second mouse support surfaces and further wherein the bead is continuous between the first and second lengths of the bead and the bead is supported within the continuous recess, an upper portion of the bead extends upwardly beyond an upper surface of the mouse support.

29. The keyboard and mouse support of claim 26 wherein the bead is substantially circular in cross section and is fixed within a recess in an upper surface of the mouse support and an upper portion of the bead extends above an upper surface of the mouse support.

30. The keyboard and mouse support of claim 29 wherein a downwardly facing surface of the keyboard support bounding the throughpassage includes a recess sized to slidably receive the upper portion of the bead extending above the upper surface of the mouse support.

31. The keyboard and mouse support of claim 24 wherein the mouse support and the keyboard support throughpassage are arcuate with respect to a longitudinal axis extending between the opposite sides of the keyboard support.

32. The keyboard and mouse support of claim 31 wherein in the first position of the mouse support at least a portion of the first mouse support surface extends in front of a forward edge of the keyboard support facing a user of the computer keyboard and mouse support and in the second position of the mouse support at least a portion of the second mouse support surface extends in front of the forward edge of the keyboard support.

33. The keyboard and mouse support of claim 24 wherein a wrist support is disposed on the upper support surface of the keyboard support adjacent a forward edge of the keyboard support facing a user of the computer keyboard and mouse support.

34. The keyboard and mouse support of claim 24 wherein the upper support surface of the keyboard support includes a wrist support affixed to the keyboard support using a ball catch fastener.

35. The computer keyboard and mouse support of claim 11 wherein the recess the he upper surface of the mouse support is arcuate in plan view.

36. The computer keyboard and mouse support of claim 11 wherein the recess in the upper surface of the mouse support is arcuate in cross section.

37. A keyboard and mouse support comprising:

a) a keyboard support having an upper support surface for supporting a computer keyboard and defining an opening for slidably receiving a mouse support, the upper support surface including a wrist support affixed to the keyboard support using a ball catch fastener;

b) the mouse support including a first mouse support surface adjacent one end of the mouse support, the mouse support being sized to slide within the keyboard support opening between first and second positions, in the first position of the mouse support the first mouse support surface extending outwardly beyond a first side of the keyboard support providing a support area for a computer mouse and in the second position of the mouse support at least a portion of the first mouse support surface being disposed within the keyboard support; and c) wherein the mouse support includes an upwardly protruding member positioned adjacent a rearward edge of the first mouse support surface to limit movement of a computer mouse placed on the first mouse support surface in a rearward direction beyond the upwardly protruding member.

38. A computer keyboard and mouse support comprising:

a) a keyboard support having an upper support surface for supporting a computer keyboard and that defines a throughpassage extending between opposite sides of the keyboard support for slidably receiving a mouse support;

b) the mouse support including first and second mouse support surfaces adjacent opposite ends of the mouse support, the mouse support being sized to slide within the keyboard support throughpassage between first and second positions, in the first position of the mouse support the first mouse support surface extending outwardly beyond one side of the keyboard support providing a support area for a computer mouse and in the second position of the mouse support the second mouse support surface extending outwardly beyond an opposite side of the keyboard support providing a support area for a computer mouse, the mouse support further including an upwardly protruding member positioned adjacent rearward edges of the first and second mouse support surfaces to limit movement of a computer mouse placed on either of the first and second mouse support surfaces in a rearward direction beyond the upwardly protruding member; and c) a wrist support affixed to the upper support surface of the keyboard support adjacent a portion of a forward edge of the keyboard support using a ball catch fastener.

* * * * *

UNITED STATES PATENT AND TRADEMARK OFFICE

CERTIFICATE OF CORRECTION

PATENT NO. : 6,497,391 B1
APPLICATION NO. : 09/383974
DATED : December 24, 2002
INVENTOR(S) : Derek Timm It is certified that error appears in the above-identified patent and that said Letters Patent is hereby corrected as shown below:

In the Claims

Column 8, Claim 3:
Line 13, delete "4.".

Column 11, Claim 35:
Line 54, replace "the he upper" with --in the upper--.

Signed and Sealed this
Twenty-fifth Day of November, 2014

Michelle K. Lee

Michelle K. Lee
*Deputy Director of the United States Patent and Trademark Office*